US010094326B2

(12) United States Patent
Pöschl

(10) Patent No.: US 10,094,326 B2
(45) Date of Patent: Oct. 9, 2018

(54) CYLINDER HEAD FOR AN INTERNAL COMBUSTION ENGINE

(71) Applicant: AVL LIST GMBH, Graz (AT)

(72) Inventor: Robert Pöschl, Judendorf-Strassengel (AT)

(73) Assignee: AVL List GmbH, Graz (AT)

( * ) Notice: Subject to any disclaimer, the term of this patent is extended or adjusted under 35 U.S.C. 154(b) by 2 days.

(21) Appl. No.: 14/898,672

(22) PCT Filed: Apr. 29, 2014

(86) PCT No.: PCT/EP2014/058665
§ 371 (c)(1),
(2) Date: Dec. 15, 2015

(87) PCT Pub. No.: WO2015/000616
PCT Pub. Date: Jan. 8, 2015

(65) Prior Publication Data

US 2016/0115897 A1 Apr. 28, 2016

(30) Foreign Application Priority Data

Jul. 4, 2013 (AT) ..... A 50436/2013

(51) Int. Cl.
*F02F 1/14* (2006.01)
*F02F 1/40* (2006.01)
(Continued)

(52) U.S. Cl.
CPC ..... *F02F 1/40* (2013.01); *F02F 1/38* (2013.01); *F02F 1/10* (2013.01)

(58) Field of Classification Search
CPC .... F02F 1/10; F02F 1/4285; F02F 1/38; F02F 2001/248; F02F 1/40; F02F 1/42
(Continued)

(56) References Cited

U.S. PATENT DOCUMENTS 4,567,859 A 2/1986 Taguchi et al.
6,817,322 B2 11/2004 Hardin
(Continued)

FOREIGN PATENT DOCUMENTS

DE 10321035 1/2005
JP S56148647 11/1981
(Continued)

OTHER PUBLICATIONS

English Abstract of JP S56148647.
(Continued)

*Primary Examiner* — Syed O Hasan
(74) *Attorney, Agent, or Firm* — Dykema Gossett PLLC

(57) ABSTRACT

The invention relates to a cylinder head (1) for an internal combustion engine having at least one fire-face-side first cooling chamber (5*a*) and one second cooling chamber (5*b*), which adjoins the first cooling chamber (5*a*) in the axial direction of the cylinder, the first and second cooling chambers (5*a*, 5*b*) being separated from each other by means of an intermediate plate (7), a central receptacle (4) being arranged for an injection nozzle or ignition device for each cylinder (Z), and the first and second cooling chambers (5*a*, 5*b*) being flow-connected to each other in the region of the central receptacle (4); and having at least two, preferably four gas exchange valve openings (2, 3) per cylinder (Z), the first cooling chamber (5*a*) having a radial cooling duct (11, 12, 13, 14) in the region of at least one valve bridge (20, 21, 22, 23) between two gas exchange valve openings (2, 3). In order to improve the flow activity in disadvantaged flow regions in the simplest possible manner, the radial cooling duct (11, 12, 13, 14) has at least one reduction in cross section (15, 16, 17, 18) in a region lying radially outside the valve bridge (20, 21, 22, 23), said region preferably being
(Continued)

further away from the cylinder axis (18) than the center (2*a*, 3*a*) of at least one gas exchange valve opening (2, 3).

11 Claims, 4 Drawing Sheets

(51) Int. Cl.
*F02F 1/38* (2006.01)
*F02F 1/10* (2006.01)

(58) Field of Classification Search
USPC ..... 123/41.34, 41.79, 41.82 R
See application file for complete search history.

(56) References Cited

U.S. PATENT DOCUMENTS 7,086,357 B2 8/2006 Vicar et al.
2004/0139933 A1* 7/2004 Obermayer ..... F01P 3/16 123/41.82 R
2005/0193966 A1* 9/2005 Mac Vicar ..... F01P 3/02 123/41.82 R
2009/0314230 A1* 12/2009 Nagenkogl ..... F01M 13/04 123/41.44

FOREIGN PATENT DOCUMENTS

JP S61149551 7/1986
JP H0674042 3/1994
WO 2011091572 8/2011

OTHER PUBLICATIONS

English Abstract of JP S61149551.
English Abstract of JP H0674042.
English Abstract of DE 10321035.

* cited by examiner

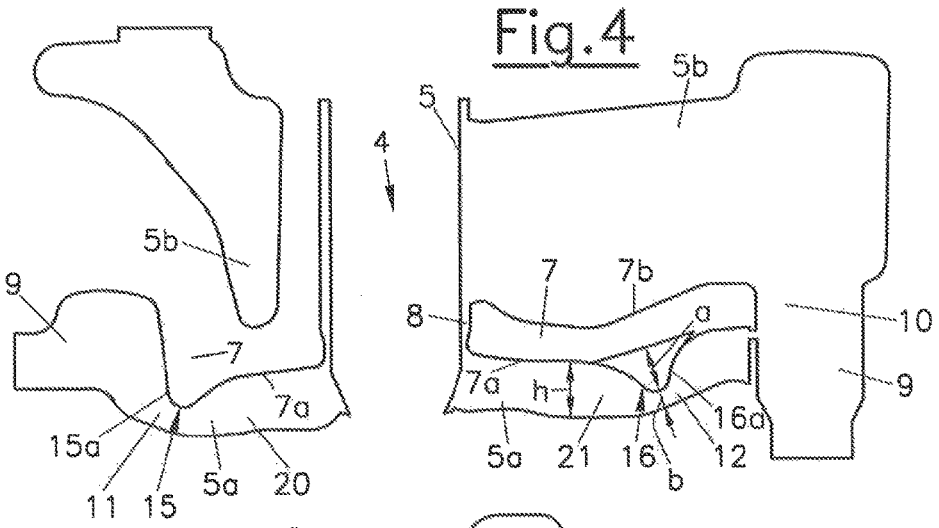
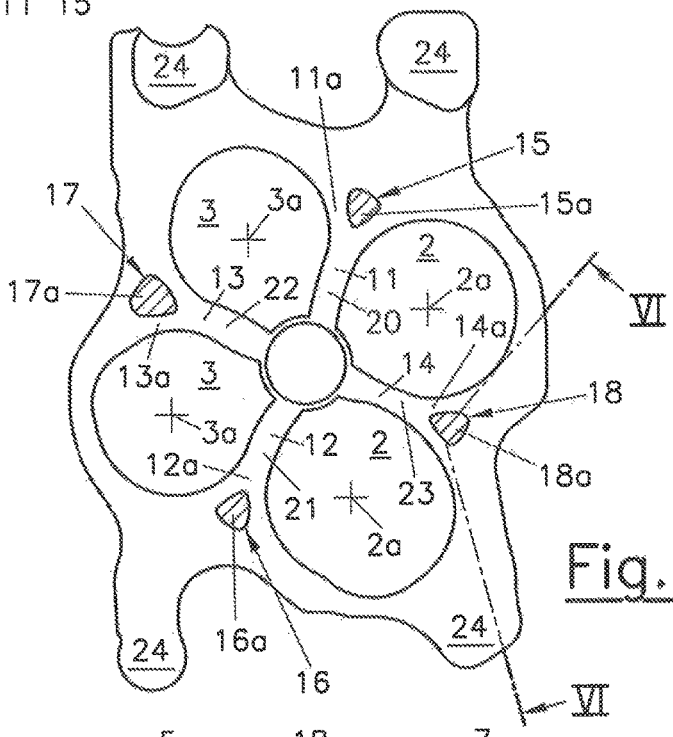
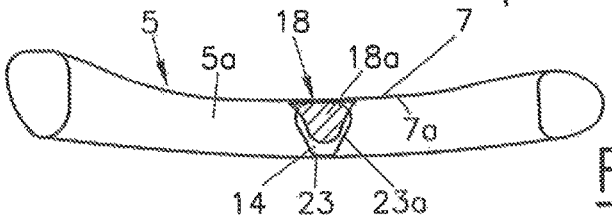
Fig.6

CYLINDER HEAD FOR AN INTERNAL COMBUSTION ENGINE

BACKGROUND OF THE INVENTION

The invention relates to a cylinder head for an internal combustion engine, comprising at least one first cooling chamber on the fire deck side and one second cooling chamber which adjoins the first cooling chamber in the axial direction of the cylinder, wherein the lower and upper cooling chamber are separated from each other by means of an intermediate deck, wherein a central receptacle is arranged for an injection nozzle or ignition device for each cylinder, and wherein the first and the second cooling chambers are flow-connected to each other in the region of the central receptacle, and comprising at least two, preferably four, gas exchange valves per cylinder, wherein the first cooling chamber comprises a radial cooling duct in the region of at least one valve bridge between two gas exchange valves.

The flow balance between the valve bridges occurs in two-part water jackets nearly exclusively by forming the radial expansion of the associated intermediate deck passages. As a result of the higher need for cooling in the exhaust valve bridge, the radial expansion is greatest at this location. This however impairs the vertical flow pulse and the approach of the flow to the injection nozzle. Since the main influencing factor of the LCF security (low cycle fatigue) on the thermal expansion along the entire valve bridge (from the injector up to the outer contour of the cylinder head) is relevant, cooling shall be provided positively over the largest possible area and shall not only be aimed at the narrow ranges of the peak temperature. As a result of the expanding cross-sections in the cooling chamber from the injection nozzle to the outer contour, the flow velocity decreases continuously and turbulence effects from the narrow gaps subside. Furthermore, stagnation points form on the circumference of the valve seats by the deflection of the flow towards the main outlets in these outer cylinder head regions. As a result of the HCF loading (high cycle fatigue), greater fire deck strengths are required in the outer regions of the valve bridges, so that the locally lower gas-side heat inputs already lead to very high structural temperatures in the range of the permissible material limit values.

It is a general object of the flow guidance to provide the adjustment of the local coefficients of speed transition and heat transfer according to the local heat inputs and the structural temperatures.

DE 10 339 244 A1 discloses a cylinder head with a first and a second cooling chamber, wherein the two partial cooling chambers are flow-connected to each other in the region of a central receptacle for an injector or a spark plug. The lower and the upper partial cooling chamber are separated from each other by an intermediate deck. Cooling ducts are arranged in the region of the valve bridges between two adjacent inlet and exhaust valves, wherein the intermediate deck comprises a lowered portion in the region of the central receptacle. The lowered portion decreases the first cooling chamber in the inner region, which has a disadvantageous effect however on the cooling of the thermally critical central regions of the fire deck.

U.S. Pat. No. 4,567,859 A shows a cylinder head for an internal combustion engine with a cooling chamber extending over several cylinders in the longitudinal direction, wherein the ceiling of the cooling chamber facing the fire deck comprises a respective suspended rib in the region of transverse planes between two adjacent cylinders. A similar configuration is also known from JP 56-148 647 A or JP 61-149 551 A.

It is the object of the invention to prevent stagnation zones in the outer region of the first cooling chamber and to improve the heat dissipation from LCF-critical zones in the outer region of the valve bridges and the valve centre.

SUMMARY OF THE INVENTION

This is achieved in accordance with the invention in such a way that the radial cooling duct comprises at least one reduction in cross-section in a region situated radially outside the valve bridge, said region preferably being farther away from the cylinder axis than the centre of at least one gas exchange valve opening.

The fire deck is the deck of the cylinder head adjoining the combustion chamber, which deck is interrupted for each cylinder by the gas exchange openings and the central receptacle for the injection nozzle or ignition device. The valve bridges are defined as the region of the fire deck in which two adjacent gas exchange openings have their closest point of approach.

The reduction in cross-section produces an increase in the velocity of the coolant flow in the region situated radially outside of the valve bridge, so that stagnation zones can be prevented. It is especially advantageous if the flow cross-section of the radial cooling duct in the region of the reduction in cross-section corresponds maximally to the flow cross-section in the region of the narrowest point of the valve bridge. A reduction is possible in the vertical expansion of the flow cross-section of the reduction in cross-section of a maximum of 80%, preferably a maximum of 50%, in comparison to the narrowest point of the valve bridge. The limits for the reduction in cross-section are imposed primarily by the production capabilities (casting technology).

It is preferably provided that the reduction in cross-section is arranged in the region of the intermediate deck, wherein preferably the reduction in cross-section is formed by a finger-shaped rib or a lowered portion in the intermediate deck. It is thus achieved that the cooling medium is deflected in the cooling duct to the fire deck and the heat dissipation from the fire deck region is improved. Furthermore, the break-off point of the region on the valve seat is also displaced. As a result, the share in the valve seat circumference which can be reached by the intensive flow can be increased, so that more heat can be removed from the fire deck.

It can be provided in a further embodiment of the invention that the reduction in cross-section is formed as an accumulation of material on the deck surface of the intermediate deck facing the first cooling chamber, wherein preferably the intermediate deck is formed in a flat way on the surface area facing the second cooling chamber in the region of the reduction in cross-section.

In a further variant of the invention, the intermediate deck is formed in such a way that on the surface area facing the second cooling chamber in the region of the reduction in cross-section follows the contour of the deck surface facing the first cooling chamber, at least approximately.

As a result of the finger-shaped ribs on the deck surface of the intermediate deck facing the first cooling chamber, which ribs are arranged in the outer region of the radial cooling duct, a general activation of the local flow activity is enabled in regions that are otherwise placed at a disadvantage. The finger-shaped ribs allow an adjustment of the flow distribution between the valve bridges by different dimensioning irrespective of the position of the main outlet of the coolant from the first cooling chamber.

The rib suspended from the intermediate deck in the outer region of the radial cooling duct allows a reduction in the stagnation points in the first cooling chamber outside of the valve bridge region, irrespective of the position of the main discharge of the coolant from the first cooling chamber. The ribs ensure that only a lower graduation of the intermediate deck passages is required.

A rib standing on the fire deck, or a continuous vertical rib from the fire deck to the intermediate deck, would not lead to any thermal improvement as a result of the accumulation of material, but definitely to HCF and LCF problems in the attachment region of the rib.

Since the suspended rib is not situated in any direction of power flow and is attached to the intermediate deck on only one side, negative effects on the component strength can be avoided. Finger-shaped ribs place high demands on the casting quality and casting technique.

It is provided in a variant of the invention which is easier to produce that the reduction in cross-section is linked at least to an inlet port and/or outlet port, preferably only one inlet or outlet port. Low demands on the casting quality and casting technique are also placed by a further embodiment in accordance with the invention in which the reduction in cross-section is formed as a continuous single rib which is attached at both ends to adjoining inlet and/or outlet ports. This variant is especially advantageous for local applications between the hot outlet ports.

The formation with finger-shaped ribs offers the advantage over continuous single ribs that the finger-shaped ribs do not cause any thermal connection between the cold inlet ports and the hot outlet ports, so that thermomechanical tension concentrations can be avoided.

BRIEF DESCRIPTION OF THE DRAWINGS

The invention will be explained below in greater detail by reference to the enclosed schematic drawings, wherein:

FIG. 4 shows the water jacket of a cylinder in a sectional view similar to FIG. 3 in a second embodiment;

FIG. 5 shows the water jacket of a cylinder in a sectional view transversely to the cylinder axis in a third embodiment;

FIG. 6 shows this water jacket in a sectional view along the line VI-VI in FIG. 5;

DETAILED DESCRIPTION OF THE DEPICTED EMBODIMENTS

Figure 1:
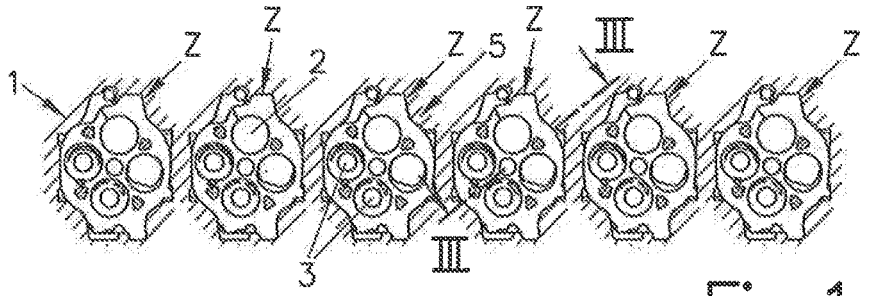
FIG. 1 shows the water jacket of a cylinder head in accordance with the invention in a view from below.
Figure 2:
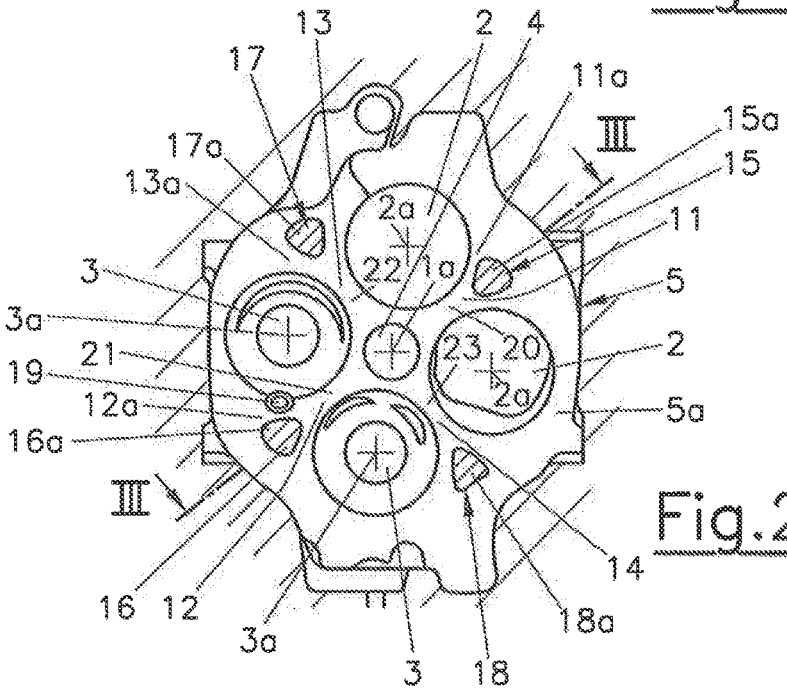
FIG. 2 shows the water jacket of a cylinder of FIG. 1 in a detailed view from below.

FIG. 1 shows the water jacket 5 of a cylinder head 1 for several cylinders Z in a view from below normally to the cylinder axis, i.e. from the side of the fire deck. The cylinder head 1 comprises four gas exchange valve openings per cylinder Z, i.e. two inlet valve openings 2 for accommodating inlet valves and two outlet valve openings 3 for accommodating outlet valves, and a central receptacle 4 for a central spark plug or a central injector. The water jacket 5 comprises a first cooling chamber 5*a* adjoining a fire deck 6 of the cylinder head 1 and a second cooling chamber 5*b* which is spaced from the fire deck 6, wherein an intermediate deck 7 is formed between the first and the second cooling chamber 5*a*, 5*b*, which intermediate deck separates the first and the second cooling chamber 5*a*, 5*b* from each other. In the region of the central receptacle 4, the intermediate deck 7 comprises a flow connection 8 between the first and the second cooling chamber 5*a*, 5*b*. A further flow connection 10 between the first and the second cooling chamber 5*a*, 5*b* can be formed in a lateral collecting region 9 of the water jacket 5 (see FIG. 4). The first cooling chamber 5*a* comprises radial cooling ducts 11, 12, 13, 14 in the region of the valve bridges 20, 21, 22, 23 between two respectively adjacent gas exchange valves, i.e. between two inlet valve openings 2, two outlet valve openings 3 and/or between one inlet valve opening 2 and one outlet valve opening 3. In an outer region 11*a*, 12*a*, 13*a*, 14*a* of the radial cooling ducts 11, 12, 13, 14, a reduction in cross-section 15, 16, 17, 18 formed by a respective finger-shaped rib 15*a*, 16*a*, 17*a*, 18*a* is arranged on the deck surface 7*a* of the intermediate deck 7 facing the first cooling chamber 5*a*. The outer region 11*a*, 12*a*, 13*a*, 14*a* with the rib 15*a*, 16*a*, 17*a*, 18*a* is farther away from the cylinder axis 1*a* of the respective cylinder Z than the centres 2*a*, 3*a* of the gas exchange valve openings 2, 3. A general activation of the local flow activity in otherwise disadvantaged regions outside of the radial cooling ducts 11, 12, 13, 14 is achieved by the finger-shaped ribs 15*a*, 16*a*, 17*a*, 18*a* on the side of the intermediate deck 7 facing the first cooling chamber 5*a* in the outside region 11*a*, 12*a*, 13*a*, 14*a* of the radial cooling ducts 11, 12, 13, 14. Flow stagnation points 19 (FIG. 2), which without the finger-shaped ribs 15*a*, 16*a*, 17*a*, 18*a* would occur radially outside of the regions of the valve bridges 20, 21, 22, 23 in the boundary region of the gas exchange valve openings 2, 3 forming valve seats for the gas exchange valves, can be displaced or reduced. By arranging the ribs 15*a*, 16*a*, 17*a*, 18*a*, heat dissipation in the region of the thermally critical points of the valve bridges 20, 21, 22, 23 and the receptacle 4 is not influenced disadvantageously, but even improved by the increase in the flow velocity without producing any distinct losses in the mass flow.

Figure 3:
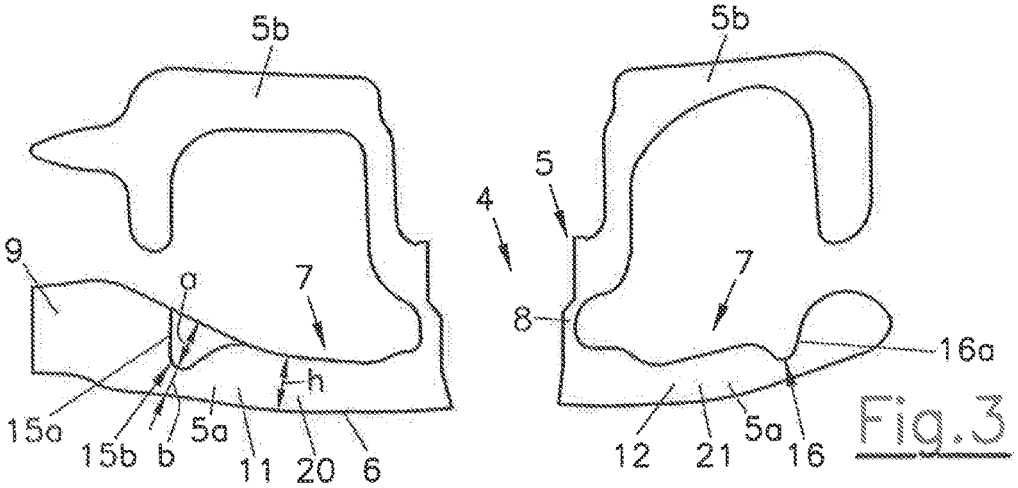
FIG. 3 shows the water jacket of a cylinder in a sectional view along the line III-III in FIG. 1 and FIG. 2 in a first embodiment.

As can be recognised in FIG. 3 and FIG. 4, the reduction in cross-section 15, 16, 17, 18 is formed as an accumulation of material on the deck surface 7*a* of the intermediate deck 7 facing the first cooling chamber 5*a*, which accumulation of material protrudes by an amount a from the deck surface 7*a* of the intermediate deck 7 facing the first cooling chamber 5*a*, which amount corresponds in the embodiment to approximately 60% to 80% of the height h of the flow cross-section in the region of the narrowest point of the valve bridge 20, 21, 22, 23. The height b of the flow cross-section of the radial cooling duct 11, 12, 13, 14 in the region of the reduction in cross-section 15, 16, 17, 18 is maximally 80%, preferably maximally 50%, more preferably approximately 20% to 40% of the height h of the flow cross-section in the region of the narrowest point of the valve bridge 20, 21, 22, 23.

The flow through the cooling duct 11, 12, 13, 14 is thus deflected towards the fire deck 6. The side of the intermediate deck 7 which faces away from the reduction in cross-section and which forms the bottom surface 7*b* of the second cooling chamber 5*b* can be formed in a flat manner without influence by the rib 15*a*, 16*a*, 17*a*, 18*a*, i.e. without any additional elevations or lowered portions (see FIG. 4). The flow in the second cooling chamber 5*b* is thus not disturbed.

In order to prevent excessive accumulations of material during the casting process, the upper contour of the intermediate deck 7 can also be adjusted to the contour of the reduction in cross-section 15, 16, 17, 18. As a result of the low flow velocities in this region, no negative deterioration in the heat transfer is expected.

FIG. 4 shows the water jacket of a cylinder in a second embodiment, wherein the further flow connection 10 between the first and second cooling chamber 5*a*, 5*b* is shown distinctly in a lateral collecting region 9 of the water jacket 5.

In the third embodiment shown in FIG. 5, the reductions in the cross-section 15, 16, 17, 18 are arranged centrally in the radial cooling ducts 11, 12, 13, 14. This arrangement can advantageously be used in case of a limitation in the casting quality or casting technique, or in the case of several outlets 24 or transfer flow possibilities from or into the cylinder housing (not shown in greater detail) or the second cooling chamber 5.

FIG. 6 shows a finger-shaped rib 18*a* in a sectional view. Such ribs suspended freely from the intermediate deck 7 place high demands on the casting quality and/or the casting technique. Reference numeral 23*a* indicates the narrow point of the radial cooling duct 14 in the region of the valve bridge 23.

Figure 7:
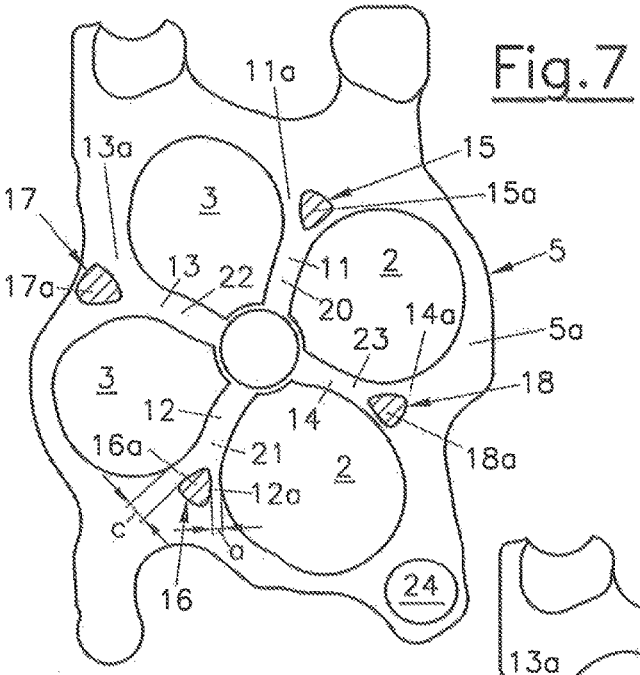
FIG. 7 shows the water jacket of a cylinder in a sectional view transversely to the cylinder axis in a fourth embodiment.

FIG. 7 on the other hand shows an embodiment in which the reductions in the cross-section 15, 16, 17, 18 are arranged at least partly off-centre in the radial cooling ducts 11, 12, 13, 14. As a result, the distance c of the reduction in cross-section 16 is greater than the distance d for example, respectively measured as the normal distance from the adjacent wall of the radial cooling duct 12. Said off-centre arrangement allows fine adjustment of the individual volume flows with respect to the outlet 10 or a promotion of the flow on the outlet ducts 3 for example.

Figure 8:
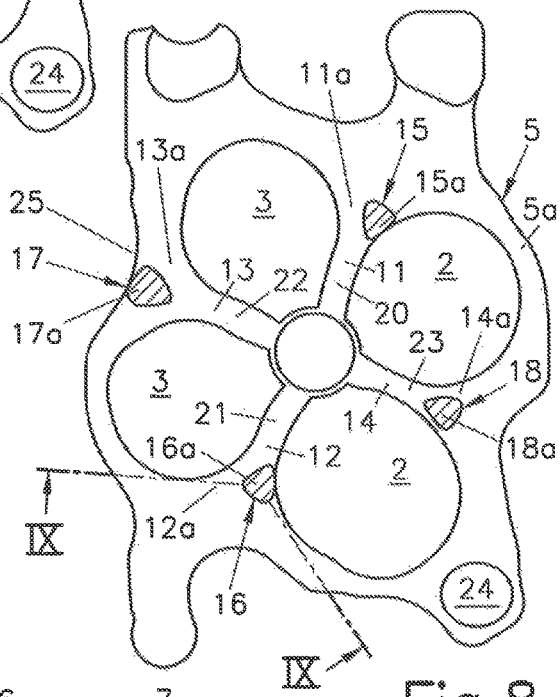
FIG. 8 shows the water jacket of a cylinder in a sectional view transversely to the cylinder axis in a fifth embodiment.

As is shown in FIG. 8 for example, the off-centre arrangement of the reductions in the cross-section 15, 16 can be continued in the most extreme of cases up to the merging with the walls of the radial cooling duct 11, 12 on the inlet side, e.g. because of limitations in the casting quality and/or casting technique. Similarly, reductions in the cross-section can also be formed in a fused manner with the outer contour 25 of the water jacket 5, e.g. in FIG. 7 the reduction in cross-section 17 is fused with the outer contour 25. On the one hand, stagnations in the coolant flow in a region of the first cooling chamber 5*a* opposite the outlet 24 can be avoided. On the other hand, this measure improves the stiffness of the cylinder head 1.

Figure 9:
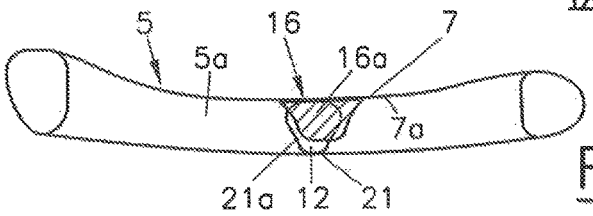
FIG. 9 shows this water jacket in a sectional view along the line IX-IX in FIG. 8.

FIG. 9 shows the finger-shaped rib 16*a* of FIG. 8 in a sectional view. The eccentric arrangement in the radial cooling duct 12 can clearly be seen, wherein the finger-shaped rib 16*a* is attached to one side on the wall of the inlet duct 2. The reduction in cross-section 16 can also be formed as an enlargement in the intermediate deck 7. This arrangement places lower demands on the casting quality and/or casting technique. Reference numeral 25*a* designates the narrow point of the radial cooling duct 12 in the region of the valve bridge 21.

Figure 10:
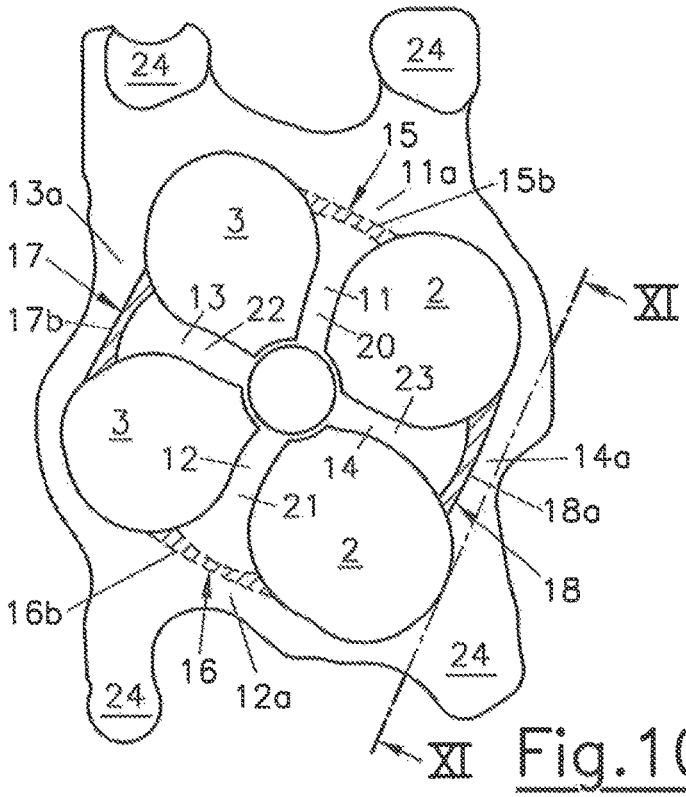
FIG. 10 shows the water jacket of a cylinder in a sectional view transversely to the cylinder axis in a sixth embodiment.

FIG. 10 shows a further embodiment, in which the reductions in the cross-section 15, 16, 17, 18 are not formed, as in the previous embodiments, by finger-shaped ribs 15*a*, 16*a*, 17*a*, 18*a* but by individual ribs 15*b* 16*b*, 17*b*, 18*b* which are continuous between opposite walls of the respective radial cooling duct. Said individual ribs 15*b* 16*b*, 17*b*, 18*b* can be provided due to limitations in the casting quality and/or casting technique for example. The individual ribs 17*b*, 18*b* are preferably drawn between similar ducts, i.e. between inlet ducts 2 and/or outlet ducts 3. The individual ribs 15*b*, 16*b*, which are shown in FIG. 10 by the dashed lines, can be realised with more difficulty due to the thermomechanical tension concentrations produced by the great temperature differences between the inlet and outlet ducts 2, 3, and require additional measures such as thinning in the centre of the individual ribs 15*b*, 16*b*.

Figure 11:
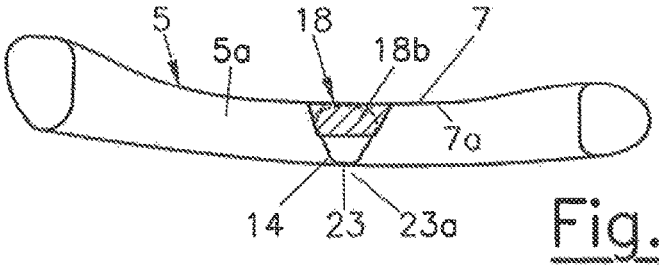
FIG. 11 shows this water jacket in a sectional view along the line XI-XI in FIG. 10.

FIG. 11 shows the continuous individual rib 18*b* of FIG. 10, which is attached on both sides to the walls of the inlet duct 2. The reduction in cross-section 18 can also be formed in this case as an enlargement of the intermediate deck 7. Similar to the embodiment shown in FIGS. 8 and 9, this variant also places lower demands on the casting quality and/or casting technique.

The invention can be used for a large variety of cylinder head concepts and cylinder numbers, irrespective of the direction of flow in the first cooling chamber 5*a*, i.e. both during a flow from the first to the second cooling chamber and also during a flow from the second to the first cooling chamber.

The invention claimed is:

1. A cylinder head for an internal combustion engine, comprising a first cooling chamber on a fire deck side and a second cooling chamber which adjoins the first cooling chamber in an axial direction of a cylinder, wherein the first and second cooling chambers are separated from each other by an intermediate deck, wherein a central receptacle is arranged for an injection nozzle or an ignition device for each cylinder, and wherein the first and the second cooling chambers are flow-connected to each other in a region of the central receptacle, and comprising at least two gas exchange valve openings per cylinder, wherein the first cooling chamber comprises a radial cooling duct in a region of a valve bridge between two gas exchange valve openings, and wherein the radial cooling duct comprises a protrusion which reduces a cross section of the radial cooling duct in a region situated radially outside the valve bridge, the protrusion in cross-section being located on a deck surface of the intermediate deck facing the first cooling chamber, and wherein the protrusion is formed by a finger-shaped rib.

2. The cylinder head according to claim 1, wherein a height of a flow cross-section of the radial cooling duct in the region of the protrusion corresponds to a maximum of 80% of a height of the flow cross-section in the region of a narrowest point of the valve bridge.

3. The cylinder head according to claim 1, wherein a height of a flow cross-section of the radial cooling duct in the region of the protrusion corresponds to a maximum of 50% of a height of a flow cross-section in a region of the narrowest point of the valve bridge.

4. The cylinder head according to claim 1, wherein a height of a flow cross-section of the radial cooling duct in the region of the protrusion corresponds to approximately 20% to 40% of a height of a flow cross-section in a region of the narrowest point of the valve bridge.

5. The cylinder head according to claim 1, wherein the protrusion is formed as an accumulation of material on the deck surface of the intermediate deck facing the first cooling chamber.

6. The cylinder head according to claim 1, wherein the intermediate deck is formed in a flat manner on a bottom surface facing the second cooling chamber in the region of the protrusion.

7. The cylinder head according to claim 1, wherein the intermediate deck, on a bottom surface facing the second cooling chamber in the region of the protrusion, approximately follows a contour of the deck surface of the intermediate deck facing the first cooling chamber.

8. The cylinder head according to claim 1, wherein the protrusion is linked at least to an inlet port and/or outlet port.

9. The cylinder head according to claim 8, wherein the protrusion is formed as a continuous individual rib which is attached at both ends to adjoining inlet and/or outlet ports.

10. The cylinder head according to claim 1, wherein the cylinder head comprises four gas exchange valve openings per cylinder.

11. The cylinder head according to claim 1, wherein the region of the protrusion is farther away from a cylinder axis than a centre of at least one gas exchange valve opening.

* * * * *